United States Patent [19]

Ray

[11] Patent Number: 4,554,685

[45] Date of Patent: Nov. 26, 1985

[54] UNDERWEAR

[76] Inventor: Hugh C. Ray, Rte. 1, Box 197, Cusseta, Ala. 36852

[21] Appl. No.: 585,533

[22] Filed: Mar. 2, 1984

[51] Int. Cl.[4] ..... A41B 9/02

[52] U.S. Cl. ..... 2/403; 2/404

[58] Field of Search ..... 2/403, 404, 405, 400, 2/401, 109, 406, 407; 128/158, 159

[56] References Cited

U.S. PATENT DOCUMENTS

| | | | |
|---|---|---|---|
| 356,497 | 1/1887 | Patten | 128/158 |
| 707,426 | 8/1902 | Kerr | 128/160 |
| 2,134,939 | 11/1938 | Goodenow | 128/159 |
| 2,505,356 | 4/1950 | Goldstein | 2/404 |
| 2,549,374 | 4/1951 | Friedman | 2/403 |
| 2,739,314 | 3/1956 | Friedman | 2/403 |
| 3,294,086 | 12/1966 | Nelkin | 128/158 |

FOREIGN PATENT DOCUMENTS

| | | | |
|---|---|---|---|
| 767726 | 1/1934 | France | 128/158 |
| 1091845 | 4/1955 | France | 2/403 |
| 1395893 | 11/1965 | France | 2/403 |

*Primary Examiner*—Louis K. Rimrodt
*Assistant Examiner*—Joseph S. Machuga
*Attorney, Agent, or Firm*—Michael C. Smith

[57] ABSTRACT

An underwear garment or similar garment having leg shield means which are adapted to fit into both crevices located at the junctures of the legs and the pelvis to form the sides of a compartment for containing the male reproduction organs which provides for less restrictive and more effective, indirect support than found in the prior art.

13 Claims, 4 Drawing Figures

UNDERWEAR

TECHNICAL FIELD

The present invention relates generally to clothing and particularly to underwear having leg shields.

BACKGROUND ART

Undergarments are well known in the art. Men's underwear having a pouch or some other means for retaining the male reproductive organs are also well known. Examples are found in the following U.S. Pat. Nos. 2,601,602; 3,207,155; 3,459,181; 3,621,846; 4,195,630 and 4,377,008.

Such underwear is typically adequate for providing support. However, these prior art retention means are also overly restrictive, since the pouch or other retention means provides affirmative, direct support for the scrotum and penis. In addition, the prior art underwear, with less restrictive retention means usually do not prevent contact between the scrotum and penis and the inside of the legs. Perspiration and heat remain a problem in the prior art. Further, the prior art underwear with retention means is unable to prevent the male reproductive organs from falling out of the pouch to one side or the other, and is also unable to prevent foreign matter from entering the leg aperture of the garment and contacting the reproductive organs. All of these problems, common to the prior art underwear, result in discomfort to the wearer and require frequent readjustment of the position of the underwear and the male reproduction organs.

The present invention solves these problems by providing underwear comprising leg shield means and unrestrictive support means.

DISCLOSURE OF INVENTION

The present invention is an underwear garment having leg shield means which are adapted to fit into both crevices located at the junctures of the legs and the pelvis. Each leg shield extends from the crevice down the leg a distance of from about one inch to about two inches. The leg shields form the sides of a compartment for containing the male reproduction organs which provides for less restrictive and more effective, indirect support than found in the prior art. The leg shield and indirect support means may also be adapted to other garments such as swimwear or shorts.

Thus a major object of the present invention is to provide underwear having leg shield means.

Another object is to provide means for preventing contact between the male reproduction organs and either leg without undue restriction of the male reproduction organs.

Still another object of the present invention is to provide means for increasing the comfort of an underwear garment wearer by providing means for absorbing perspiration.

Yet another object is to provide means for preventing male reproduction organs from falling or hanging through a leg aperture of an undergarment.

Another object of this invention is to provide means for preventing ingress of foreign matter into an underwear garment through a leg aperture.

Yet another object is to provide swimwear, shorts and similar garments incorporating the above referenced features.

BRIEF DESCRIPTION OF THE DRAWINGS

While the specification concludes with claims particularly pointing out and distinctly claiming the subject matter which is regarded as the invention, it is believed that the invention, objects, features, and advantages thereof will be better understood from the following description taken in connection with the accompanying drawings in which like parts are given like identification numerals and wherein:

BEST MODE FOR CARRYING OUT THE INVENTION

Figure 1:
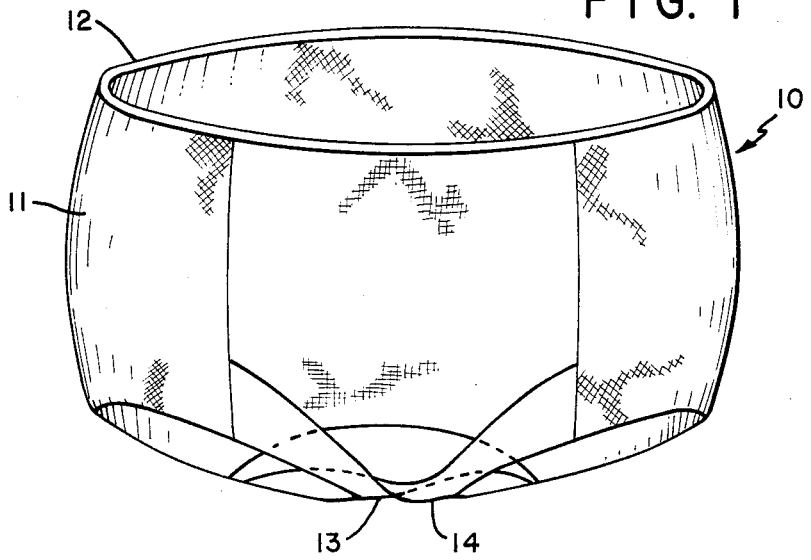
FIG. 1 is an elevation of the underwear of the present invention having the front panel thereof removed in order to clearly show the leg shields.

The present invention is a male undergarment or similar garment having leg shields. As FIG. 1 illustrates, the underwear indicated generally at 10 comprises a body member 11, a waist band 12, a first leg shield 13 and a second leg shield 14. Front panels (15, 16 of FIG. 2) are removed for clarity. The body member 11 forms the back and both sides of the garment as shown. The top of body member 11 cooperates with waistband 12 to define an upper aperture which provides for encircling of the torso. A front portion of the first leg shield 13 is attached to a first front-most edge of the body member 11, and a rear portion of first leg shield 13 is attached to the bottom rear portion of body member 11, thus forming a first leg aperture. The front portion of first leg shield 13 is generally vertically aligned, conforming to the front surface of the leg of the wearer. First leg shield 13 conforms to the surface of the wearer's leg as it extends around the inside of the leg and then begins to rotate to a generally horizontal alignment where it is secured to the rear bottom portion of body member 11. Second leg shield 14 is similarly secured to a second front-most edge of body member 11, and a rear portion of second leg shield 14 is attached to the bottom rear portion of body member 11, thus forming a second leg aperture. The front portion of second leg shield 14 is generally vertically aligned, conforming to the front surface of the leg of the wearer. Second leg shield 14 conforms to the surface of the wearer's leg as it extends around the inside of the leg and then begins to rotate to a generally horizontal alignment where it is secured to the rear bottom portion of the body member 11. When the garment 10 is put on, it is pulled up until the top of each leg shield 13,14 fits in each respective crevice located at the juncture of the top, inner surface of the leg and the crotch of the wearer, thereby acting as a gauge of how far to pull the garment up. The leg shields 13,14 extend around the inner surface of each leg a vertical width of from about one inch to about two inches. In this manner, each leg of the wear is isolated from other parts of the wearer's body. Shields 13,14 absorb perspiration, and increase comfort by preventing contact between the inner surface of the wearer's leg an the scrotum and penis.

Figure 2:
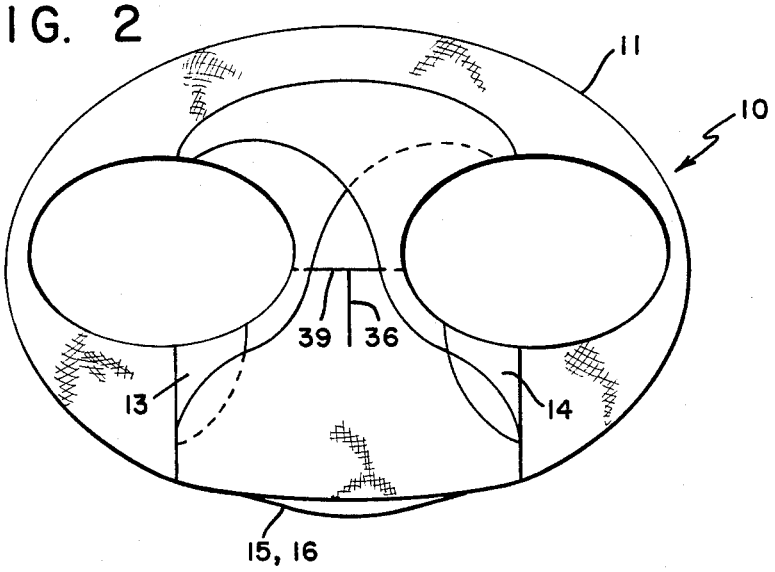
FIG. 2 is a top view of the underwear of the present invention.

FIG. 2 is a view from the top of garment 10. The leg shields 13,14 cross behind the longitudinal axis of the wearer's body (not shown) in order to prevent pinching of the rear portion of the scrotum. The top portion of each leg shield 13,14 curves from the front of one leg to the rear of the opposite leg, crossing the buttox crevice generally perpendicular thereto in order to avoid becoming lodged therein. FIG. 2 also shows an inner front panel 15 and an outer front panel 16 which are attached to both front-most edges of body portion 11, to the bottom, leg aperture forming edge of each leg shield 13,14 and to the rear bottom edge of the body portion 11. Left and right lower portions of each panel 15,16 are also seamed together, forming a slight pouch. Thus, a compartment is formed for containing the scrotum and penis. Opposite curved fly edges of each panel 15,16 are not joined to another position of the garment 10 in order to permit access to the interior of the garment compartment through and between the front pnels 15,16.

Figure 3:
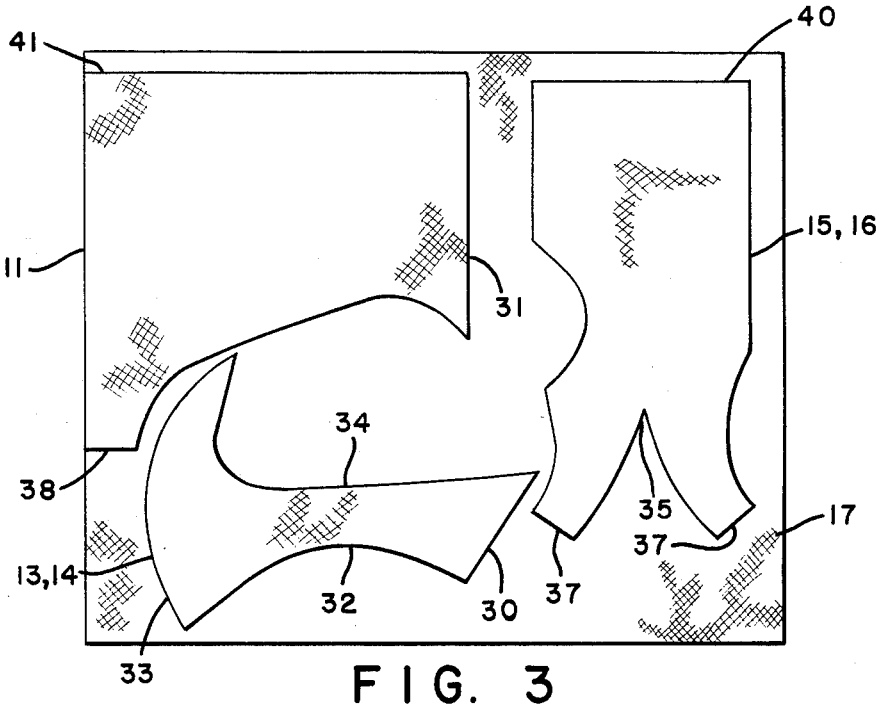
FIG. 3 is a view of the patterns for cutting the pieces which form the garment.

FIG. 3 illustrates the patterns for the garment pieces. Cloth 17 (preferrably cotton or cotton blend material) is folded at the left side, and body member 11 is cut on the fold. Two identical leg shields 13,14 are cut from folded cloth 17 and are reversed when incorporated into the garment 10. Two identical front panels 15,16 are also cut from folded cloth 17 and are reversed when incorporated into garment 10. The v-portion 35 of the front panels 15,16 are also clearly shown in FIG. 3. These v-portions 35 are seamed together forming the pouch as shown in FIG. 2. Each leg shield 13,14 has a straight front edge 30 which is attached vertically to the front-most edge 31 of body member 11 as explained above. The lower edges 32 of each leg shield 13,14 is concave as shown and cooperates with body member 11 and front panels 15,16 to form the interior portions of the leg apertures of the garment. The rear edge 33 of each leg shield 13,14 is convex as shown and is secured to body member 11 as discussed above. The upper edge 34 of each leg shield 13,14 has an elongated straight portion which is designed to fit in the crevice at the juncture of the top of the wearer's leg and his crotch as discussed above. Upper edge 34 also has a curved portion which curves to generally perpendicular to the elongated straight portion thereof. Front panels 15,16 have a v-portion 35 which is seamed together as discussed above at seam 36 of FIG. 2, which forms a generally straight bottom surface 37 of each front panel 15,16. Bottom surfaces 37 of the front panels 15,16 are joined to the rear bottom edge 38 of body member 11 at seam 39 of FIG. 2. Front panel top edges 40 and body member top edge 41 are joined to waist band 12 as discussed above.

Figure 4:
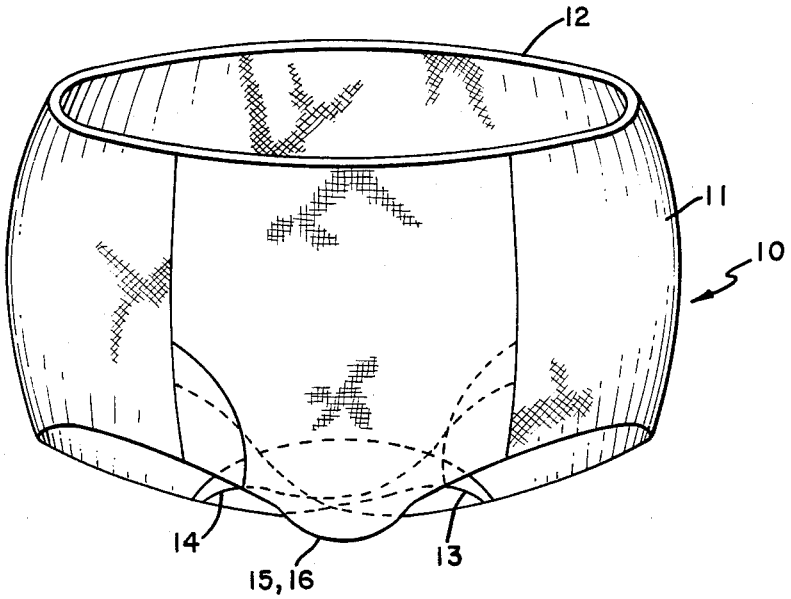
FIG. 4 is a front view of the finished garment of the present invention.

The completed garment 10 is shown in FIG. 4. It is preferred that the top edge 34 of the leg shields 13,14 are elasticized to provide tension for assuring that the top edges 34 remain in the crevice of the crotch and leg juncture, thereby maintaining the compartment. Elastic means are also sewn into each finished leg opening and into the waist band 12. Seams are joined with binding tape where necessary in the conventional manner. The finished garment isolates each leg and forms a compartment for containing the penis and scrotum. In addition, the leg shields 13,14 of the compartment prevent the scrotum and penis from falling out of either leg opening. The leg shields 13,14 also prevent ingress of foreign matter. The leg shields 13,14 may also be used with swimwear and shorts.

While this invention has been described in detail with particular reference to a preferred embodiment thereof, it will be understood that variations and modifications can be effective within the spirit and scope of the invention as described hereinbefore and as defined in the appended claims.

INDUSTRIAL APPLICABILITY

This invention is capable of exploitaton in the garment industry. It is particularly useful in underwear and similar garments.

I claim:

1. In a garment of the type having a waist opening and two leg openings for covering the lower torso of the wearer, the improvement comprising:

a body member for covering the rear and both sides of the lower torso;

a first leg shield secured to a first front-most edge of said body member, extending around the inner surface of a first leg of the wearer and secured to the rear bottom portion of said body member;

a second leg shield secured to a second front-most edge of said body member, extending around the inner surface of a second leg of the wearer and secured to the rear bottom portion of said body member; wherein each leg shield has a straight front edge, concave lower edge, a convex rear edge, and an upper edge having an elongated straight portion and a portion which curves to generally perpendicular to said elongated straight portion; and at least one front panel connected to the front-most portions of said body member and connected to the rear bottom edge of said body member, thereby forming a compartment between said leg shields;

further provided that contact between the inner surface of the wearer's leg and the scrotum and penis is prevented.

2. The apparatus of claim 1 wherein said first leg shield is generally vertically aligned at its juncture with said first front-most body member portion, and conforms to the surface of the wearer's leg as it extends around the inside of the leg and then rotates to a generally horizontal alignment at its juncture with the rear bottom portion of said body member; and wherein said second leg shield is generally vertically aligned at its juncture with said second front-most portion of said body member, and conforms to the surface of the wearer's leg as it extends around the inside of the leg and then rotates to a generally horizontal alignment at its juncture with the rear bottom portion of said body member.

3. The apparatus of claim 2 wherein the bottom edge of said first leg shield cooperates with said body member to form a first leg opening; and wherein the bottom edge of said second leg shield cooperates with said body member to form a second leg opening.

4. The apparatus of claim 2 wherein the top edge of said first leg shield fits into a first crevice located at the juncture of the first leg and the crotch of the wearer; and wherein the top edge of said second leg shield fits into a second crevice located at the juncture of the second leg and the crotch of the wearer.

5. The apparatus of claim 4 wherein said first leg shield extends around the inner surface of said first leg a vertical width of from about one inch to about two inches; and wherein said second leg shield extends around the inner surface of said second leg a vertical width of from about one inch to about two inches.

6. The apparatus of claim 4 wherein the top edge of said first leg curves from the front of said first leg to the rear of said second leg and wherein the top edge of said second leg shield curves from the front of said second leg to the rear of said first leg.

7. The apparatus of claim 6 wherein said leg shield top edges cross behind the longitudinal axis of the wearer's body.

8. The apparatus of claim 6 wherein said leg shield top edges cross the buttox crevice of the wearer generally perpendicular thereto.

9. The apparatus of claim 6 wherein the top edges of said leg shields are elasticized.

10. The apparatus of claim 9 wherein said leg openings are elasticized.

11. The apparatus of claim 2 wherein said panel further comprises a inner panel, an outer panel, and means for access to said compartment between said inner panel and said outer panel.

12. The apparatus of claim 11 further comprising an elasticized waist band connected to the upper edge of said panels and to the upper edge of said body member.

13. The apparatus of claim 12 wherein each of said panels is seamed along the center of its lower portion, thereby forming a pouch.

* * * * *